US010029889B2

(12) United States Patent
Alasentie et al.

(10) Patent No.: US 10,029,889 B2
(45) Date of Patent: Jul. 24, 2018

(54) METHOD FOR HANDLING AND MODERNIZING ROPES IN AN ELEVATOR AND ARRANGEMENT FOR DISMANTLING ROPES OF AN ELEVATOR

(71) Applicants: Pentti Alasentie, Espoo (FI); Jarmo Reijonen, Hyvinkaa (FI); Sakari Korvenranta, Hyvinkaa (FI)

(72) Inventors: Pentti Alasentie, Espoo (FI); Jarmo Reijonen, Hyvinkaa (FI); Sakari Korvenranta, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 184 days.

(21) Appl. No.: 15/092,900

(22) Filed: Apr. 7, 2016

(65) Prior Publication Data

US 2016/0318738 A1 Nov. 3, 2016

(30) Foreign Application Priority Data

Apr. 30, 2015 (FI) ..... 20155321

(51) Int. Cl.
*B66B 19/02* (2006.01)
*B66B 7/06* (2006.01)

(52) U.S. Cl.
CPC ..... *B66B 19/02* (2013.01); *B66B 7/062* (2013.01)

(58) Field of Classification Search
CPC ..... B66B 19/02; B66B 7/062
See application file for complete search history.

(56) References Cited

U.S. PATENT DOCUMENTS

2011/0162915 A1 7/2011 Hagg et al.
2012/0255150 A1 10/2012 Alasentie

FOREIGN PATENT DOCUMENTS

| | | | |
|---|---|---|---|
| EP | 2676915 | A1 | 12/2013 |
| JP | S5516552 | A | 12/1980 |
| JP | H02117581 | A | 5/1990 |
| WO | WO 2011/076908 | A1 | 6/2011 |

OTHER PUBLICATIONS

Finnish Search Report for Application No. 20155321 dated Dec. 30, 2015.
Extended European Search Report dated Sep. 5, 2016 issued in corresponding European Application No. 16166221.8.

*Primary Examiner* — Ryan J Walters
(74) *Attorney, Agent, or Firm* — Harness, Dickey & Pierce, P.L.C.

(57) ABSTRACT

The invention relates to a method for handling and modernizing ropes in an elevator, which elevator comprises at least an elevator car arranged to run in an elevator shaft along the guide rails, a counterweight connected to the elevator car with hoisting ropes from above, a hoisting machinery with a traction sheave above the elevator car, and compensating ropes connected between the elevator car and the counterweight through a compensating mechanism at a lower part of the elevator shaft. The old hoisting ropes and compensating ropes are dismantled when the elevator car has been run to the upper part of the elevator shaft without a risk of losing the friction on the traction sheave.

17 Claims, 9 Drawing Sheets

Figure 1:
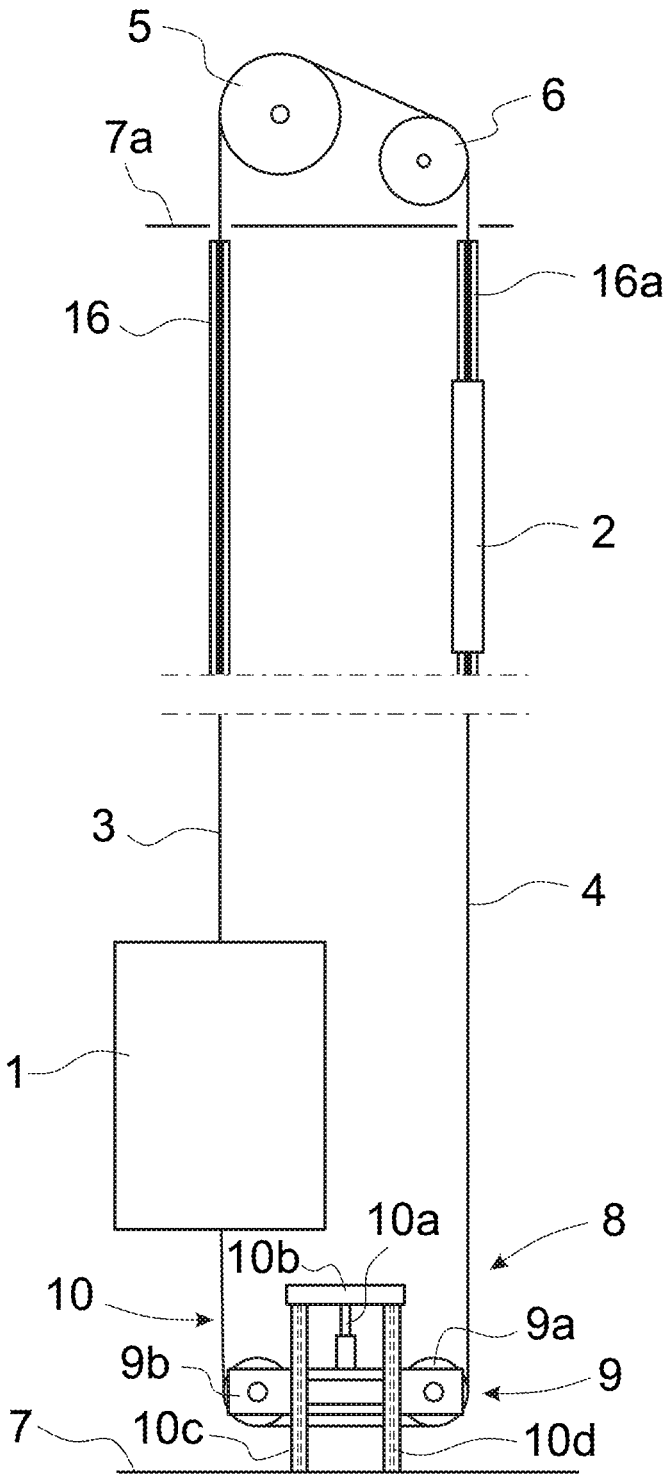

METHOD FOR HANDLING AND MODERNIZING ROPES IN AN ELEVATOR AND ARRANGEMENT FOR DISMANTLING ROPES OF AN ELEVATOR

This application claims priority to Finnish Patent Application No. 20155321 filed on Apr. 30, 2015, the entire contents of which are incorporated herein by reference.

The present invention relates to a method as defined in the preamble of claim 1 for handling ropes in an elevator and a method as defined in the preamble of claim 9 for modernizing in an elevator, and an arrangement as defined in the preamble of claim 17 for dismantling compensating ropes and/or hoisting ropes of an elevator.

In tall buildings elevator hoisting ropes consisting of a set of parallel similar steel ropes are long and substantially thick and for that reason they are usually very heavy. In addition in tall buildings also compensating ropes are needed to compensate the weight of the hoisting ropes. The first ends of the compensating ropes are usually fastened under the elevator car, either directly into a car of into a frame-like car sling that supports the car. From the car the compensating ropes are led downwards towards the bottom of the elevator shaft where they go around one or more deflection sheaves and then the second ends of the compensating ropes are fastened into the counterweight. In tall buildings the compensating ropes form usually a set of parallel ropes where a number of similar ropes can be for instance two or more. It is clear that this kind of set consisting of several long and substantially thick ropes is also very heavy.

The problem in prior art is the handling of the sets of the hoisting ropes and compensating ropes during installation and dismantling. Especially when changing old ropes to new ropes the dismantling of the sets of ropes is very laborious, time consuming and can also be dangerous. One risk factor is the dismantling of the compensating ropes. If the compensating ropes are unfastened in a wrong way there is a great risk to lose friction on the traction sheave in which case the whole elevator system falls into an unbalanced situation.

One object of the present invention is to eliminate drawbacks of prior art technology and to achieve an advantageous, fast, easy and safe method for handling ropes in an elevator especially when dismantling compensating ropes and hoisting ropes in tall high-rise buildings, either for dismantling, chancing of modernization purposes. The method according to the invention for handling ropes in an elevator is characterized by what is presented in the characterization part of claim 1, and the method according to the invention for modernizing ropes in an elevator is characterized by what is presented in the characterization part of claim 9, and the arrangement for dismantling compensating ropes and/or hoisting ropes of an elevator is characterized by what is presented in the characterization part of claim 17. Other embodiments of the invention are characterized by what is presented in the other claims.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

Also the terms used must be understood in their broad meaning. For instance, the terms disconnect and unfasten used in connection with ropes may both mean the same, for instance, an act of separating ropes from they fastening points, by loosing a fixing or cutting the ropes.

The method according to the invention has several useful advantages. Among other things it makes it possible to unfasten the compensating ropes safer and faster than in prior art systems without a fear to lose friction on the traction sheave in any phase. Another advantage is that it makes it easier to modernize the elevator for instance by changing thick and heavy steel ropes to much lighter and more durable thin hoisting elements that are made of much durable material than steel. For instance, a flat belt comprising a carbon fiber core and a high-friction coating can be used instead of heavy metal ropes. This gives additional advantages. For example elevator energy consumption in high-rise buildings can be cut significantly because the moving masses of the elevator drop significantly thanks to the much lighter ropes. And the higher the building the more weight can be removed, and therefore the more energy can be saved.

A particular advantage of using the invention is improved safety during dismantling the old compensation rope/ropes of an elevator.

An advantage of using the invention is improved efficiency particularly when dismantling the old compensation rope/ropes of an elevator.

Figure 2:
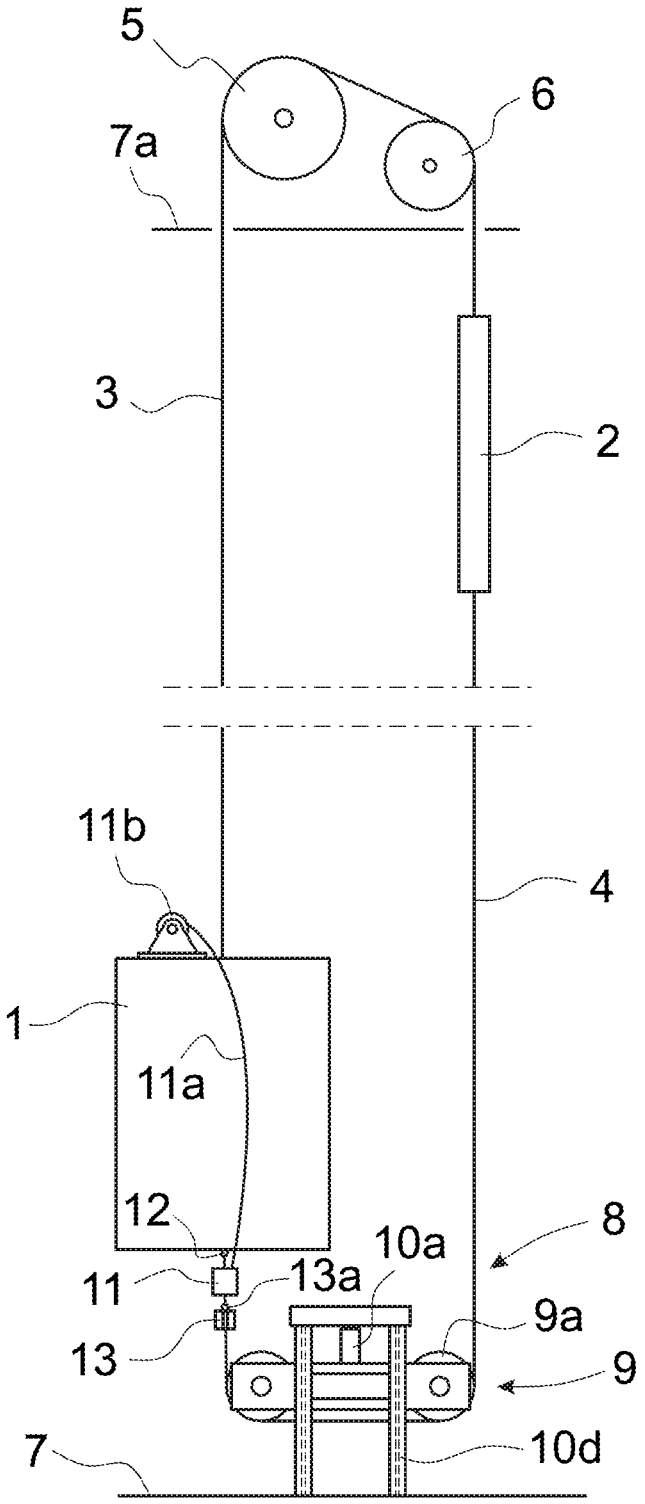
Figure 3:
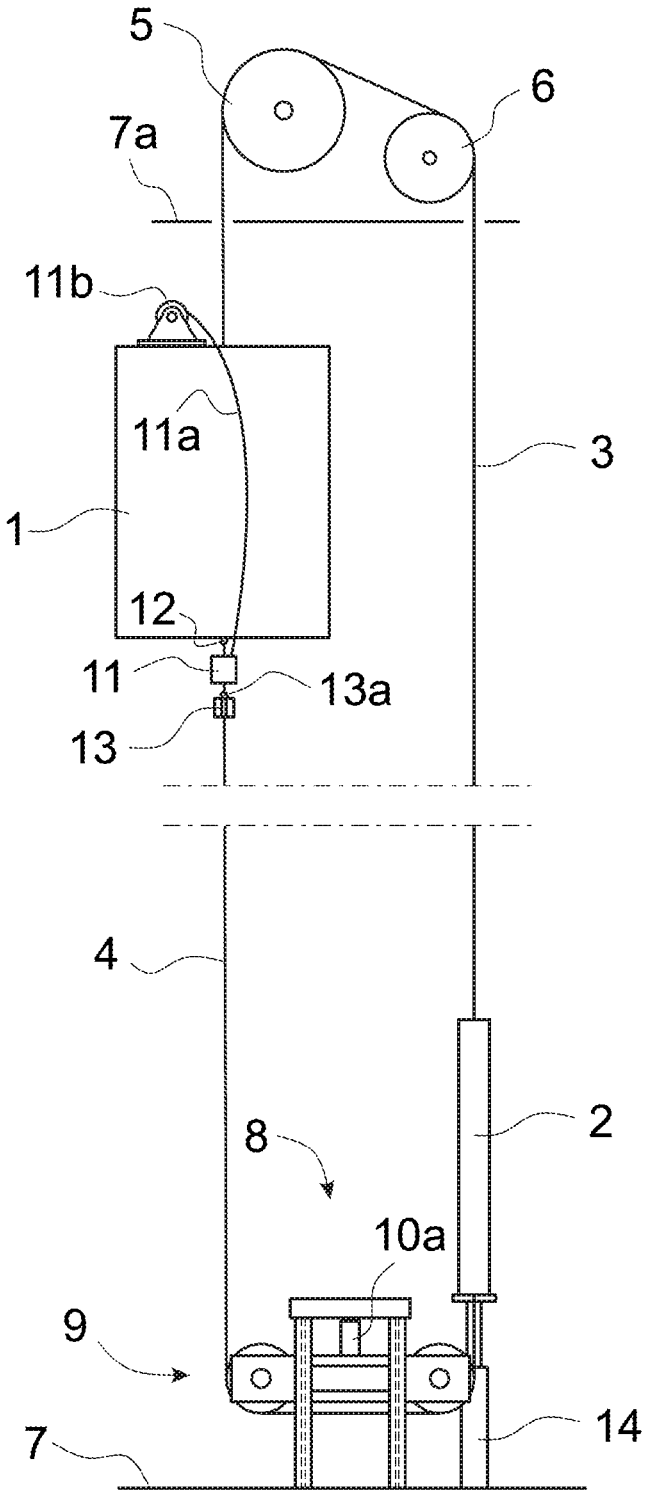
Figure 4:
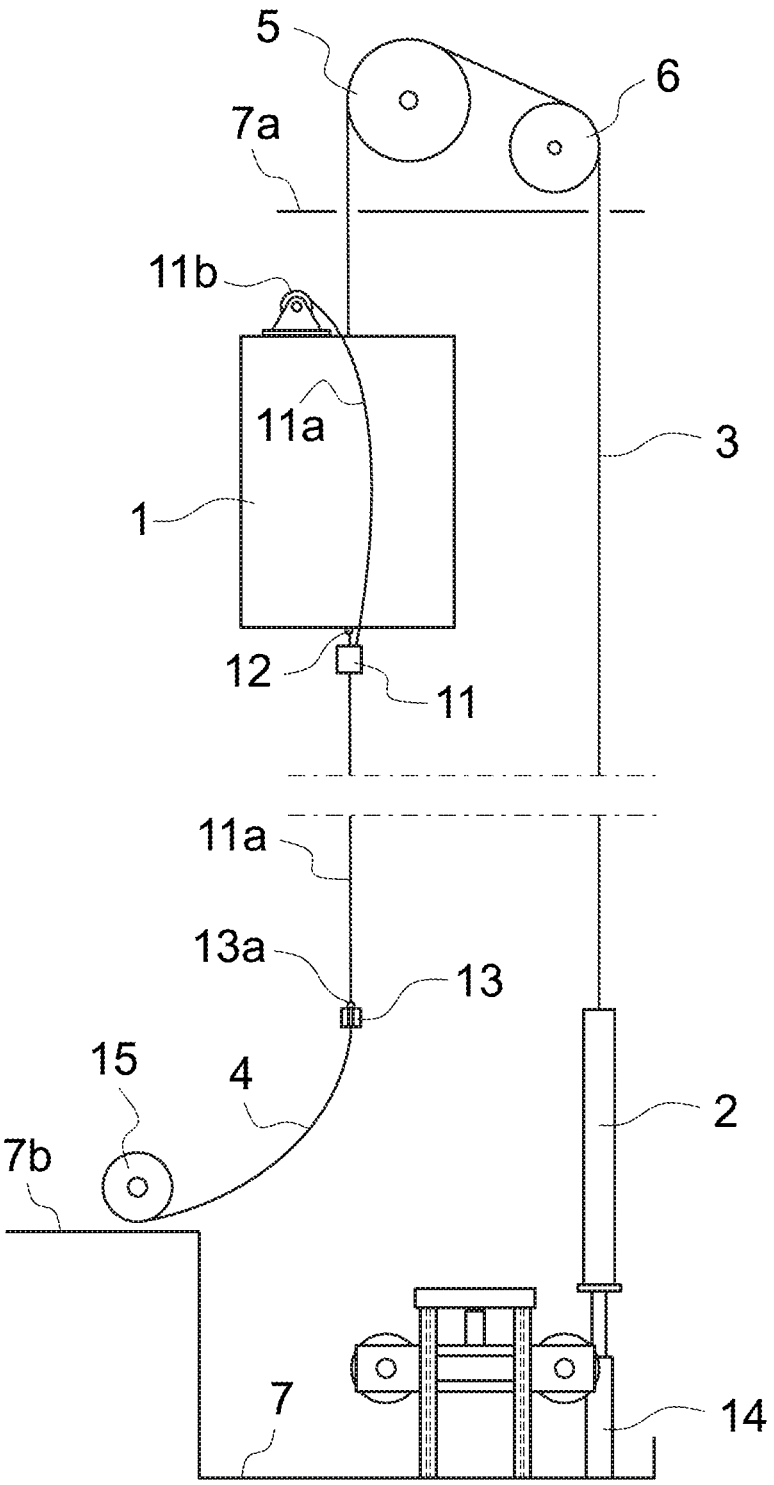
Figure 5:
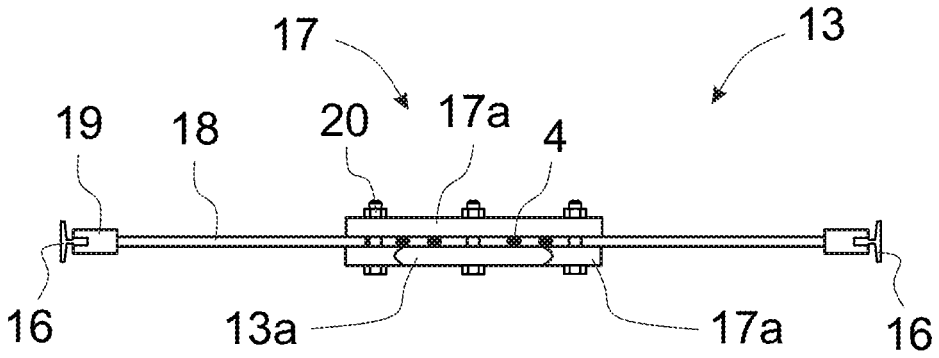
Figure 6:
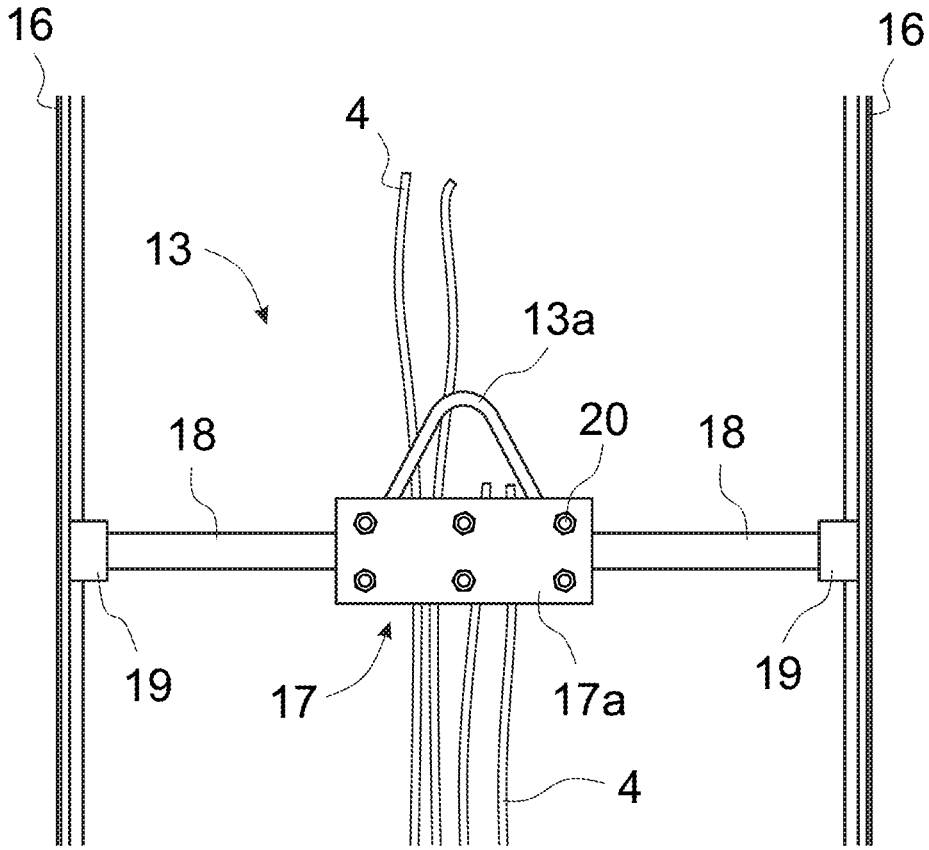
Figure 7:
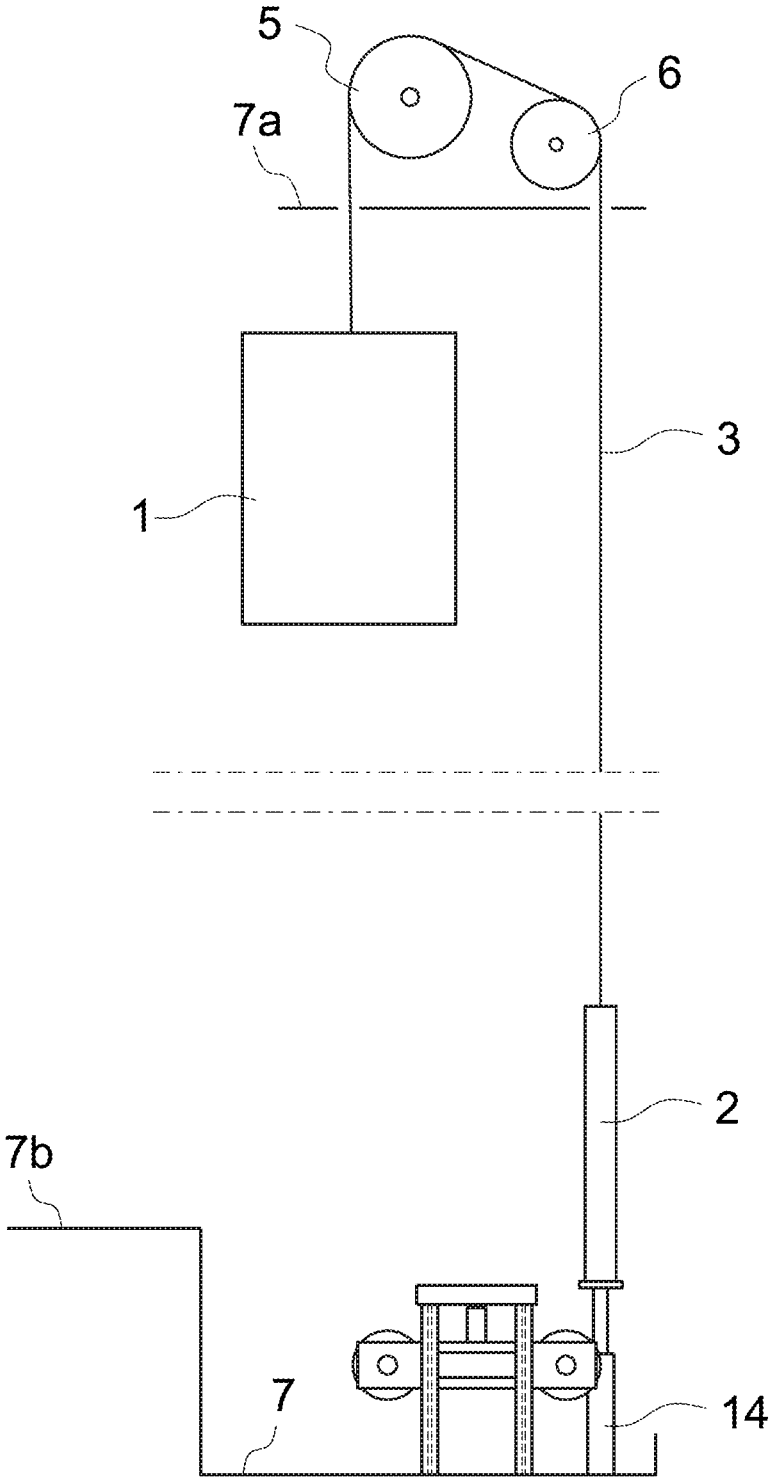
Figure 8:
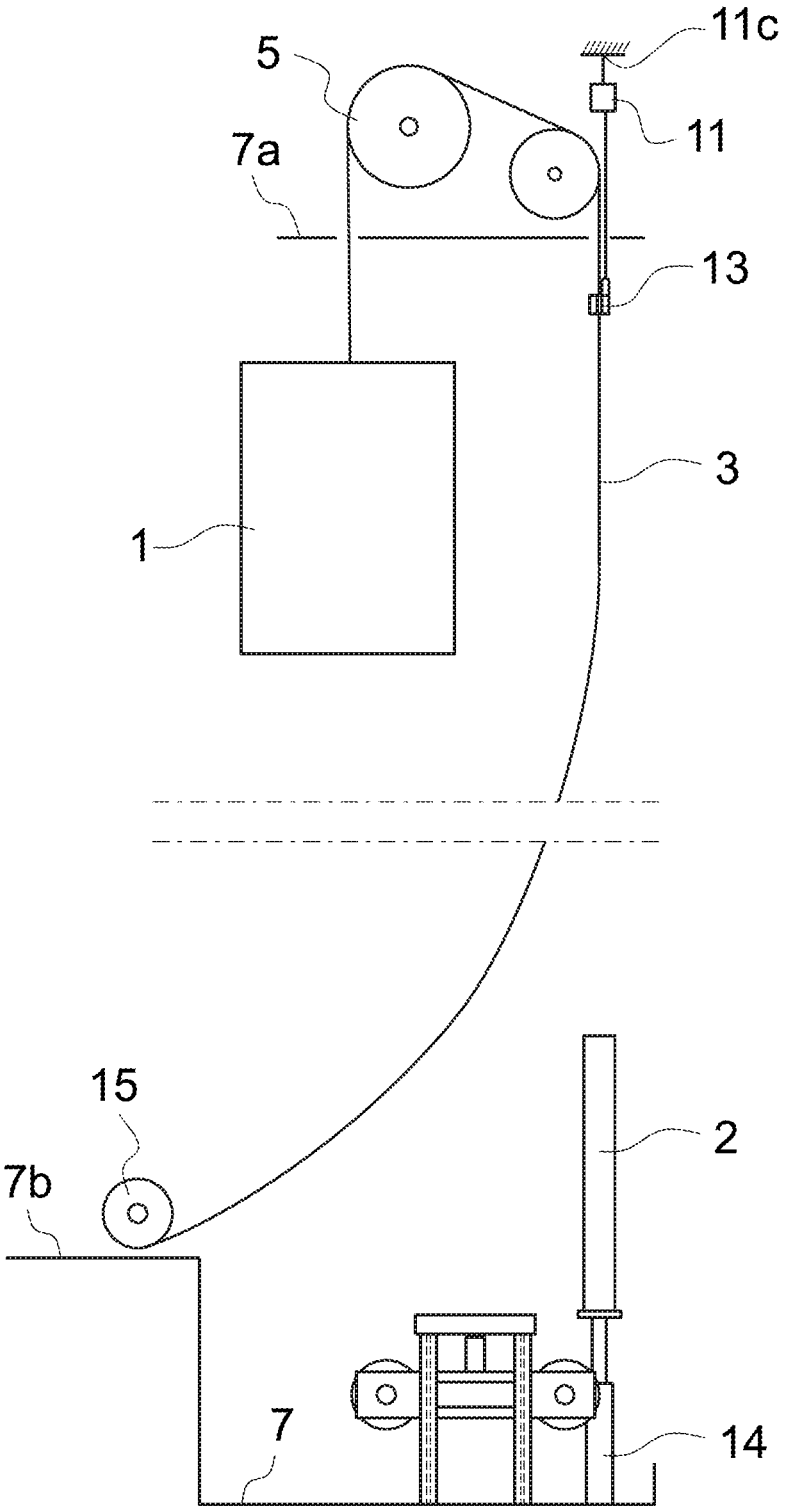
Figure 9:
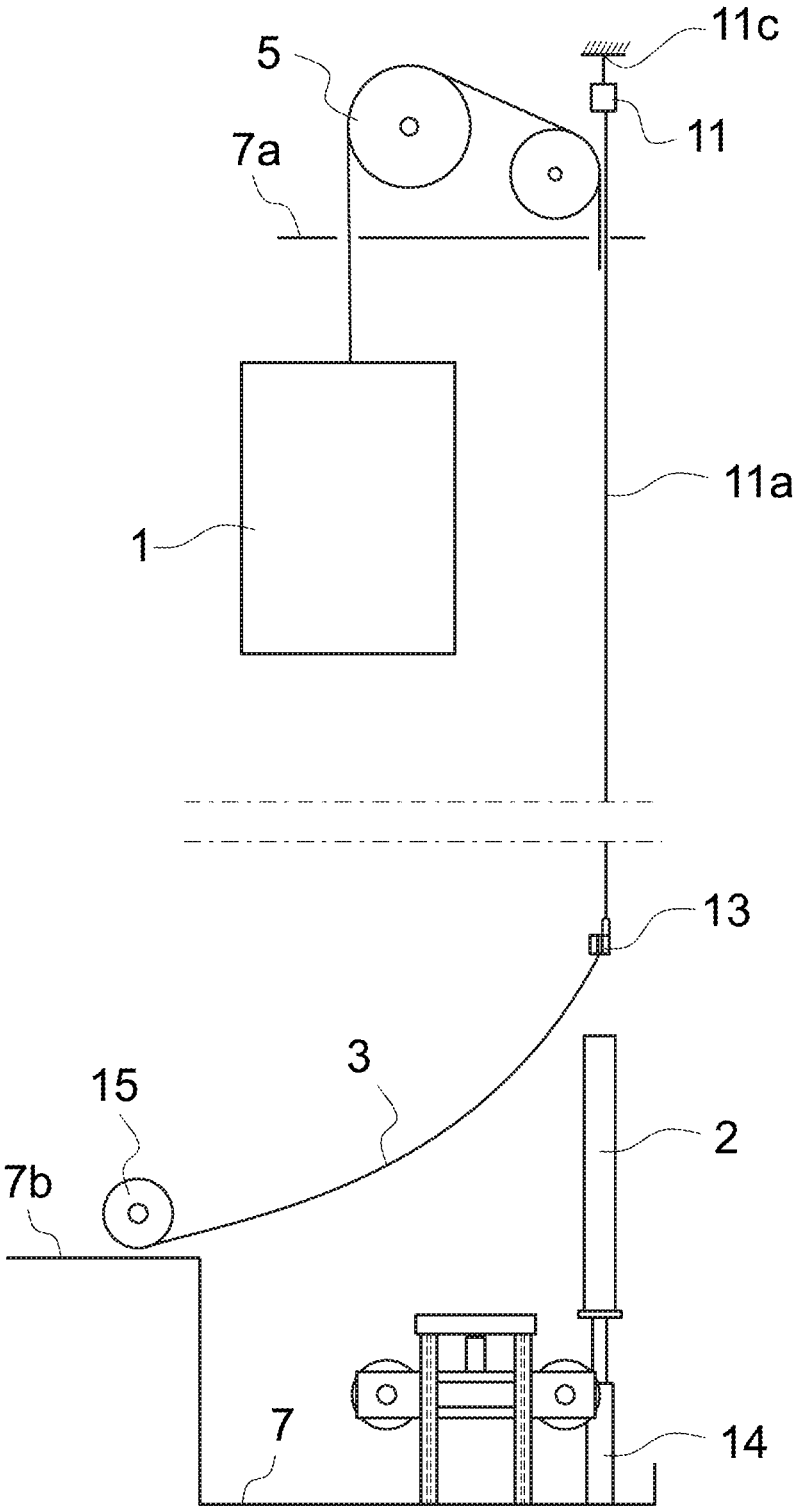
Figure 10:
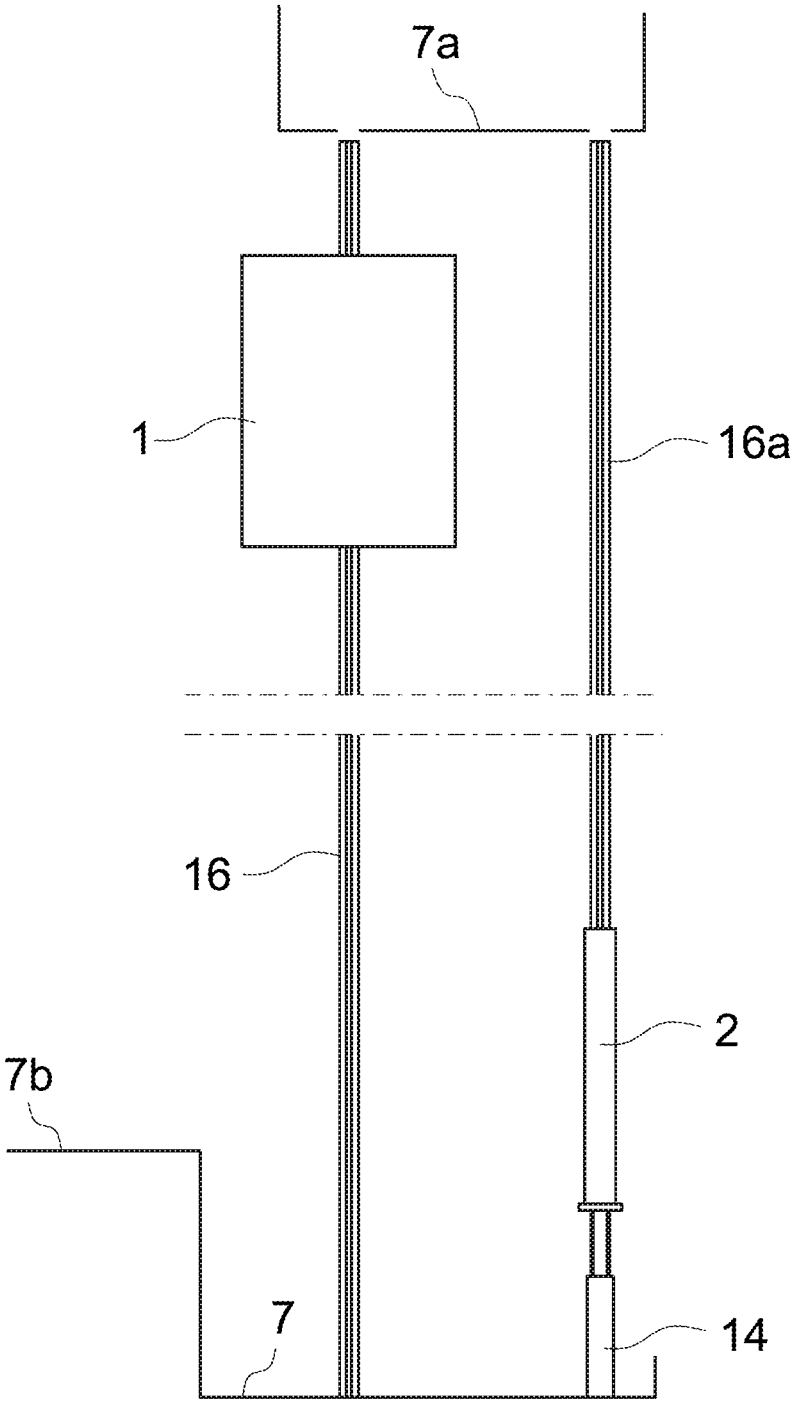

In the following, the invention will be described in detail by the aid of example embodiments by referring to the attached simplified and diagrammatic drawings, wherein FIG. 1 presents in a simplified and diagrammatic side view, and cut in a vertical direction, a high-rise building elevator arrangement where the method according to the invention can be used, FIG. 2 presents in a simplified and diagrammatic side view the first main step of the method according to the invention in an elevator arrangement of FIG. 1, FIG. 3 presents in a simplified and diagrammatic side view the second main step of the method according to the invention in an elevator arrangement of FIG. 1, FIG. 4 presents in a simplified and diagrammatic side view the third main step of the method according to the invention in an elevator arrangement of FIG. 1, FIG. 5 presents in a simplified and diagrammatic top view a roping tool according to the invention mounted onto the guide rails of the elevator car, FIG. 6 presents in a simplified and diagrammatic side view the roping tool according to the invention mounted onto the guide rails of the elevator car, FIG. 7 presents in a simplified and diagrammatic side view, and cut in a vertical direction, a high-rise building elevator arrangement ready for dismantling the hoisting ropes, FIG. 8 presents in a simplified and diagrammatic side view, and cut in a vertical direction, a high-rise building elevator arrangement where the dismantling of the hoisting ropes has just started, FIG. 9 presents in a simplified and diagrammatic side view, and cut in a vertical direction, a high-rise building elevator arrangement where the dismantling of the hoisting ropes has proceeded further, and FIG. 10 presents in a simplified and diagrammatic side view, and cut in a vertical direction, a high-rise building elevator arrangement where the dismantling of the hoisting ropes has been completed and the elevator is ready for new ropes.

FIG. 1 presents in a simplified and diagrammatic side view a typical elevator roping arrangement used in tall high-rise buildings. For the sake of clarity only the upper end and lower end of the elevator arrangement in an elevator shaft is presented. A typical elevator arrangement comprises an elevator car 1 and a counterweight 2 that go up and down guided by their guide rails 16, 16*a*. For the sake of clarity the elevator car guide rail 16 and the counterweight guide rail 16*a* are shown only in FIGS. 1 and 10 in one side of the car and counterweight, and further in FIG. 1 the guide rails 16, 16*a* are shown only at the upper part of the elevator shaft. The elevator car 1 and the counterweight 2 are connected together with a bundle of parallel hoisting ropes 3 whose first ends are fastened into the elevator car 1, either directly into a car 1 or into a frame-like sling that supports the car 1. For the sake of clarity the sling is presented neither in FIG. 1 nor in the other figures. The hoisting ropes 3 are led from the elevator car 1 to the counterweight 2 around a traction sheave 5 and if needed also around a deflection sheave 6 which both are situated either at top part of the elevator shaft or in a machine room above the elevator shaft. In this embodiment the traction sheave 5 and the deflection sheave 6 are placed in the machine room above the elevator shaft and the hoisting ropes 3 go through holes in the floor 7*a* of the machine room.

As mentioned earlier the long and for that reason heavy steel ropes causes balancing problems in high-rise buildings. For that reason compensating ropes 4 are usually needed in high-rise elevator arrangements. The compensating ropes 4 also comprise a bundle of heavy parallel steel ropes that are fastened between the elevator car 1 and counterweight 2 so that the first ends of the compensating ropes 4 are fastened into the lower part of the elevator car 1, either directly into a car 1 or into a frame-like sling. From the car 1 the compensating ropes 4 are led to the counterweight 2 around a deflection sheave arrangement 9 comprising usually one or two deflection sheaves 9*a* per each compensating rope 4, and from the deflection sheave arrangement 9 the compensating ropes 4 are led to the counterweight 2 where the second ends of the compensating ropes 4 are fastened.

The deflection sheave arrangement 9 is a part of a compensating mechanism 8 that is situated on the bottom 7 of the elevator shaft. In this embodiment the deflection sheave arrangement 9 comprises two sets of deflection sheaves 9*a*, each set on its own shaft that is fastened into a frame 9*b* of the deflection sheave arrangement 9. In that case the deflection sheaves 9*a* are bearing-mounted on their own shafts. The structure can also be such that the shafts of the deflection sheaves 9*a* are bearing-mounted on the frame 9*b* of the deflection sheave arrangement 9.

The compensating mechanism 8 also includes a tensioning mechanism 10 to keep the tension of the compensating ropes 4 within allowed limits. The tensioning mechanism 10 includes vertical support beams 10*c* that has vertical guide rails 10*d* to guide vertical movements of the deflection sheave arrangement 9, and a tensioning device 10*a* that can be a hydraulic cylinder or a set of additional weights. In this embodiment the tensioning device 10*a* is a hydraulic cylinder that is fastened between the frame 9*b* of the deflection sheave arrangement 9 and a fixed point formed by a top beam 10*b* of the compensating mechanism 8. The deflection sheave arrangement 9 can basically move up and down on the guide rails 10*d* but usually the tensioning device 10*a* pushes the deflection sheave arrangement 9 downwards so that a sufficient tension remains in the compensating ropes 4.

FIG. 2 presents in a simplified and diagrammatic side view a part of the first main step of the method according to the invention in an elevator arrangement like shown in FIG. 1. The method in this phase concerns the dismantling of the compensating ropes 4 in an elevator in a high-rise building.

In the method the first main step is to run the elevator car 1 down to a lower part of the elevator shaft close to the lowermost landing floor 7*b* to such a position where a roping tool 13 can be mounted easily on the elevator car rails 16 below the elevator car 1 and above the compensating mechanism 8, and where an auxiliary hoist 11, such as a Tirak hoist or a corresponding hoist can be installed between the roping tool 13 and the elevator car 1. When the elevator car 1 is in its correct position in a lower part of the elevator shaft either on the lowermost landing floor 7*b* or close to it the deflection sheave arrangement 9 of the compensating mechanism 8 are lifted upwards, for instance to its uppermost position and locked there to get the compensating ropes 4 loose enough. The lifting reduces tension in the compensating mechanism 8. After that the first ends of the compensating ropes 4 are unfastened from their fastening points in the elevator car 1. The next step is to mount the roping tool 13 onto the elevator car guide rails 16 and fasten the unfastened ends of the compensating ropes 4 to the roping tool 13. If the end parts of the compensating ropes 4 above the roping tool 13 remain too long the extra length is cut away.

In the next step the auxiliary hoist 11, such as a Tirak hoist or a corresponding hoist is installed between the roping tool 13 and the elevator car 1 so that the hoist 11 is suspended from the elevator car 1 or from the car sling from its point of suspension 12 and the roping tool 13 is suspended by the auxiliary hoist 11 through its suspension hook 13*a*. In order to make this possible an auxiliary hoisting rope reel 11*b* and cables for the auxiliary hoist 11 are installed in their position on the roof of the car 1 and the auxiliary hoisting rope 11*a* is guided from the reel 11*b* through the auxiliary hoist 11 to the suspension hook 13*a* of the roping tool 13. After that the compensating ropes 4 are tightened with the auxiliary hoist 11 to prevent loose ropes during the upward run of the elevator car 1.

FIG. 3 presents in a simplified and diagrammatic side view a part of the second main step of the method according to the invention. In this phase the elevator car 1 with the auxiliary hoist 11 is run to the top part of the elevator shaft. The run is done as a service run or other slow motion safety run from the control panel of the elevator. The run lifts the auxiliary hoist 11, the roping tool 13 and the unfastened ends of the compensating ropes 4 at the same time as high as possible and the counterweight 2 descents to its lowermost position close to the compensating mechanism 8, so that the second ends of the compensating ropes 4 are attainable from the bottom 7 of the elevator shaft.

At this stage the next step is to install suitable support elements 14 under the counterweight 2 at a predetermined height, and to run the counterweight 2 onto the support elements 14. After that the counterweight 2 cannot go further down.

The next step is to arrange empty rope reels 15 on the lowermost landing floor 7*b*. A part of this step is shown in FIG. 4 where the reels 15 are shown in a simplified way. After that the second ends of the compensating ropes 4 are released from the counterweight 2 and routed to the empty reels 15 where they are fastened to the reels 15. The releasing can be done either by cutting the compensating ropes 4 near their second ends or unfastening the second ends from their fastening points. During this phase the elevator car 1 is also parked and/or locked in its position, for example, with the help of the safety gears of the elevator. Also separate clamps on the guide rails 16 can be used. In addition the elevator car 1 can be secured with separate safety chains. Now the next step is possible and the roping tool 13 with the first ends of the bundle of compensating ropes 4 is lowered down by the help of the auxiliary hoist 11 and the compensating ropes 4 starting with their unfastened second ends are simultaneously guided to the rope reels 15. After that the final steps are unfastening the first ends of the compensating ropes 4 from the roping tool 13, removing the roping tool 13 from the elevator car rails 16 and finally removing the reels 11*b* and 15 and the auxiliary hoist 11.

One embodiment of the roping tool 13 suitable for the method described above is presented in FIGS. 5 and 6. In FIG. 5 the roping tool 13 is seen on elevator guide rails 16 in a top view and the in FIG. 6 the roping tool 13 is seen on the elevator guide rails 16 in a side view. The roping tool 13 comprises, for instance, a two-piece frame 17, two arms 18 extending sideways to opposite directions from the frame 17, two slide blocks 19 that are installed on the elevator guide rails 16 to slide up and down along the guide rails 16, and of a suspension hook 13*a*. The first ends of the arms 18 are fastened to the frame 17 and the slide blocks 19 are fastened to the second ends of the arms 18. The frame 17 comprises two parallel plates 17*a* that can be tightened against each other with a set of tightening bolts and nuts 20. When using the roping tool 13 the unfastened ends of the compensating ropes 4 are placed between the plates 17*a* and the plates 17*a* are tightened against each other so that the ropes 4 are pressed between the plates 17*a* so tightly that the roping tool 13 can carry the total mass of the compensating ropes 4. The same roping tool 13, suitably adapted, can also be used on counterweight rails 16*a* when dismantling hoisting ropes 3 of the elevator.

The method according to the invention makes it possible to remove the compensating ropes 4 without a risk of losing friction on the traction sheave 5. During the dismantling process the balance in the elevator arrangement remains constant and there is no need to improve the friction by loading the elevator car 1 or unloading the counterweight 2.

The method according to the invention described above can advantageously be a part of a modernization process where old and heavy steel ropes are changed to much lighter roping elements such as flat belts comprising a carbon fiber core and a unique high-friction coating. In that case the first phase of the method for dismantling the compensating ropes 4 is similar to the method described above. After the final steps of dismantling the compensating ropes 4 the next phase now is dismantling of the old hoisting ropes 3. FIGS. 7-10 describe that phase.

Thus, the next step now is to arrange a new set of empty rope reels 15 for the hoisting ropes 3 to be dismantled on the lowermost landing floor 7*b*. After that, in the next step, the second ends of the hoisting ropes 3 are unfastened from the counterweight 2. And in the next step a roping tool 13, either the same used when dismantling the compensating ropes 4 or a different one, is mounted onto the guide rails 16*a* of the counterweight 2. The mounting is done from the roof of the elevator car 1 and the roping tool 13 is mounted preferably as high as possible, in this case just under the roof of the elevator shaft. The roping tool 13 is then suspended from an auxiliary hoist 11 that is hung, for instance, from a solid point 11*c* in the machine room. After that the hoisting ropes 3 are fastened firmly into the roping tool 13 just under the roof of the elevator shaft. If the mass of the whole bundle of hoisting ropes 3 exceeds the lifting capacity of the auxiliary hoist 11 the bundles to be lowered at the same time must be made smaller, and the lowering step must be done repeatedly more than once.

After the hoisting ropes 3 are fastened into the roping tool 13 just below the roof of the elevator shaft the roping tool is slightly lifted with the auxiliary hoist 11 to get somewhat loose to the hoisting ropes 3 above the roping tool 13. Now the next step is to cut the fastened hoisting ropes 3 just above the roping tool 13 and unfasten the first ends of the hoisting ropes 3 from their fixing points in the elevator car 1. The cut pieces of the hoisting ropes 3 between the elevator car 1 and the roping tool 13 are moved away, for instance, pulled into the machine room above.

Now the next step is to lower the rope bundle of hoisting ropes 3 down together with the roping tool 13. At the same time the lower ends of the hoisting ropes 3 are guided to the rope reels 15 on the lowermost landing floor 7*b* and the hoisting ropes 3 are wound to the rope reels 15 simultaneously when lowering them down. Finally the rope reels 15 with dismantled hoisting ropes 3 are removed from the lowermost landing floor 7*b*.

At this stage the elevator car 1 is locked in its position at the top part of the elevator shaft and the counterweight 2 is at the lower part of the elevator shaft supported by the support elements 14, and the elevator has neither hoisting ropes 3 nor compensating ropes 4. In addition the elevator car 1 and the counterweight 2 are supported by their guide rails 16 and 16*a*.

Now the installation of new hoisting elements and compensating elements can be initialized. When using ultra light hoisting elements, such as flat belts comprising a carbon fiber core and a unique high-friction coating, the first step is to position the elevator car 1 on a correct level for the new hoisting elements, and park it again with safety gears and safety chains. After that the old compensating mechanism 8 is replaced by a new compensating mechanism that is aligned according to the new layouts, and also old lifting arrangements are removed from the elevator shaft.

For modernization also some modifications are done in the machine room. One possibility is to replace the old machinery, traction sheave 5 and bedplate with the new ones. If the old machinery is intended to be used, only the traction sheave 5 and possibly some other replacement parts must be changed and the bedplate must be either modified or changed and aligned according to new layouts.

Finally the fastening points of the hoisting ropes and compensating ropes in the car or car sling and in the counterweight are modified or replaced with new parts that are suitable for new type of hoisting and/or compensating elements.

FIG. 10 presents the situation where the elevator is ready for new roping with all old and unsuitable components removed or modified. After that the new type of the hoisting and/or compensating elements with their machineries and accessories can be installed in a known way.

It is obvious to the person skilled in the art that the invention is not restricted to the examples described above but that it may be varied within the scope of the claims presented below. Thus, for instance the order of the method steps may differ from the order presented in the claims, or method steps may be less than presented in the claims.

The invention claimed is:

1. A method for dismantling compensating ropes in an elevator, the compensating ropes having a first end and a second end, the method comprising:

first disconnecting the first end of compensating ropes from an original connection with an elevator car;

attaching the first end of the compensating ropes to an auxiliary hoist carried by the elevator car;

running the elevator car upwards to an upper part of an elevator shaft together with the first end of the compensating ropes;

attaching the elevator car to the upper part of the elevator shaft;

supporting a counterweight at a lower part of the elevator shaft;

second disconnecting the second end of the compensating ropes from the counterweight; and lowering the first end of the compensating ropes using the auxiliary hoist.

2. The method for dismantling compensating ropes in an elevator according to claim 1, wherein the method further comprises:

routing out of the elevator shaft the second end of the compensating ropes; and leading out the compensating ropes from the elevator shaft while lowering the first end of the compensating ropes using the auxiliary hoist.

3. The method for dismantling compensating ropes in an elevator according to claim 1, further comprising:

slackening the compensating ropes before the first disconnecting disconnects the first end of the compensating ropes, the slackening including reducing tension in a compensating mechanism;

fastening the first end of the compensating ropes to a roping tool to attach the first end of the compensating ropes to the auxiliary hoist such that the attaching attaches the first end of the compensating ropes to the auxiliary hoist using the roping tool;

routing out of the elevator shaft the second end of the compensating ropes after the second disconnecting disconnects the second end of the compensating ropes from the counterweight and before the lowering lowers the first end of the compensating ropes; and leading out the compensating ropes from the elevator shaft, simultaneously with the lowering of the first end of the compensating ropes, wherein the lowering includes lowering the first end of the compensating ropes along with the roping tool.

4. The method for dismantling compensating ropes in an elevator according to claim 3 further comprising:

mounting the roping tool on elevator car guide rails below the elevator car, before the running runs the elevator car upwards.

5. The method for removing compensating ropes in an elevator according to claim 3, wherein the slackening further comprises:

slackening the compensating ropes by lifting a deflection sheave arrangement of the compensating mechanism upwards into a higher position and locking the deflection sheave arrangement in the higher position before the first disconnecting disconnects the first end of the compensating ropes.

6. The method for dismantling compensating ropes in an elevator according to claim 3, further comprising:

parking the elevator car in a position in the upper part of the elevator shaft before the lowering lowers the first end of the compensating ropes.

7. The method for dismantling compensating ropes in an elevator according to claim 1, wherein the running upwards of the elevator car includes using a service run or other slow motion safety run via a control panel of the elevator.

8. The method for dismantling compensating ropes in an elevator according to claim 1 further comprising:

installing empty rope reels on a lowermost landing floor outside the elevator shaft, before the lowering lowers the first end of the compensating ropes.

9. A method for modernizing ropes in an elevator, comprising:

dismantling the compensating ropes according to claim 1;

dismantling hoisting ropes, the hoisting ropes having a first end and a second end, the dismantling hoisting ropes including disconnecting the second end of the hoisting ropes from the counterweight, suspending the hoisting ropes from the auxiliary hoist at suspension points, cutting the hoisting ropes at a cut point just above the suspension points to separate the hoisting rope into a first portion from the first end to the cut point and a second portion from a cut end at the cut point to the second end, the second portion of the hoisting ropes being suspended from the auxiliary hoist, the second portion of the hoisting ropes having a cut end and a second end, disconnecting the second end of the second portion of the hoisting ropes from the counterweight, disconnecting the first end of the first portion of the hoisting ropes from fixing points in connection with the elevator car, removing the first portion of the hoisting ropes, and lowering the cut end of the second portion of the hoisting ropes down with the auxiliary hoist;

modifying the elevator shaft and a machine room to be suitable for new hoisting ropes and new compensating ropes; and installing the new hoisting ropes and the new compensating ropes.

10. The method for modernizing ropes in an elevator according to claim 9, wherein the dismantling of the compensating ropes further includes, routing out of the elevator shaft the second end of the compensating ropes before lowering the first end of the compensating ropes using the auxiliary hoist;

leading out the compensating ropes from the elevator shaft while lowering the first end of the compensating ropes down using the auxiliary hoist; and the dismantling of the hoisting ropes further includes, routing out of the elevator shaft the second end of the second portion of the hoising ropes, before lowering the cut end of the second portion of the compensating ropes; and leading out the-second portion of the hoisting ropes from the elevator shaft while lowering the cut end of the second portion of the hoisting ropes.

11. The method for modernizing ropes in an elevator according to claim 9, wherein the dismantling of the compensating ropes further includes, slackening the compensating ropes before the first disconnecting disconnects the first end of the compensating ropes, the slackening including reducing tension in a compensating mechanism, fastening the first end of the compensating ropes to a roping tool such that the attaching attaches the first end of the compensating ropes to the auxiliary hoist using the roping tool, routing out of the elevator shaft the second end of the compensating ropes, before lowering the first end of the compensating ropes, the lowering including lowering, via the auxiliary hoisting, the roping tool together with the first end of the compensating ropes; and leading out the compensating ropes from the elevator shaft simultaneously with lowering the first end of the compensating ropes; and dismantling the hoisting ropes further includes, placing the roping tool in a position at the upper part of the elevator shaft, suspending the roping tool by installing an auxiliary hoist in a machine room, fastening the hoisting ropes into the roping tool, before cutting the hoisting ropes just above the roping tool, routing, out of the elevator shaft, the second end of the second portion of the hoisting ropes, before lowering the cut end of the second portion of the hoisting rope, wherein the lowering includes lowering, via the auxiliary hoist, the roping tool together with the cut end of the second portion of the hoisting ropes, and leading out the hoisting ropes from the elevator shaft, simultaneously with lowering the cut end of the second portion of the hoisting ropes.

12. The method for modernizing ropes in an elevator according to claim 11, wherein the dismantling of the hoisting ropes further comprises:

mounting the roping tool on counterweight guide rails high in the elevator shaft, before lowering the cut end of the second portion of the hoisting ropes.

13. The method for modernizing ropes in an elevator according to claim 11, wherein the dismantling of the hoisting ropes further comprises:

leading out the second portion of the hoisting ropes simultaneously with lowering the roping tool and the cut end of the second portion of the hoisting ropes.

14. The method for modernizing ropes in an elevator according to claim 9, wherein the dismantling of the hoisting ropes further comprises:

arranging empty rope reels on the lowermost landing floor.

15. The method for modernizing ropes in an elevator according to claim 9, wherein the hoisting ropes and the compensating ropes are replaced with the new hoisting ropes and the new compensating ropes, the new hoisting ropes being lighter than the hoisting ropes and the new compensating ropes being lighter than the compensating ropes.

16. The method for modernizing ropes in an elevator according to claim 9, wherein the new hoisting ropes and the new compensating ropes are flat belts including a carbon fiber core and a high-friction coating.

17. The method for modernizing ropes in an elevator according to claim 9, further comprising:

iteratively suspending the hoisting ropes, cutting the hoisting ropes, and lowering the second portion of the hoisting ropes prior to removing the first portion of the hoisting ropes.

* * * * *